US006006566A

United States Patent [19]

Huelsberg et al.

[11] Patent Number: 6,006,566

[45] Date of Patent: Dec. 28, 1999

[54] METHOD AND DEVICE FOR REMOVING A SLUG FROM A HYDROFORMING TOOL

[75] Inventors: Thomas Huelsberg, Buchholz/Holm Sepp; Ralf Puenjer, Seevetal, both of Germany

[73] Assignee: DaimlerChrysler AG, Stuttgart, Germany

[21] Appl. No.: 09/262,833

[22] Filed: Mar. 5, 1999

[30] Foreign Application Priority Data

Mar. 5, 1998 [DE] Germany ..... 198 09 519

[51] Int. Cl.[6] ..... B21D 26/02; B21D 28/28

[52] U.S. Cl. ..... 72/55; 72/427; 83/54; 29/421.1

[58] Field of Search ..... 72/55, 56, 427; 83/22, 53, 54, 177; 29/421.1

[56] References Cited

U.S. PATENT DOCUMENTS

| | | | |
|---|---|---|---|
| 3,991,456 | 11/1976 | Lieser | 72/55 |
| 4,989,482 | 2/1991 | Mason | 72/55 |
| 5,398,533 | 3/1995 | Shimanovski et al. | 72/55 |
| 5,460,026 | 10/1995 | Schafer | 72/55 |
| 5,816,089 | 10/1998 | Marando | 72/55 |

*Primary Examiner*—David Jones
*Attorney, Agent, or Firm*—Evenson, McKeown, Edwards & Lenahan, P.L.L.C.

[57] ABSTRACT

A method and a device for removal of a slug separated from a hollow profile by means of a fluidic internal pressure from a hydroforming tool. The slug is separated from the hollow profile from the inside to the outside by the retraction of a plunger integrated into the hydroforming tool and clearing a slug channel when retracted, and is forced out of the die cavity of the hydroforming tool into the slug channel. Then, with the hollow profile in a zero-pressure state, the slug, which after it is pressed in abuts the end of the plunger, is removed by a removal tool from the hydroforming tool. In order to remove slugs from the hydroforming tool in any desired position of the slug channel that leads into the die of the hydroforming tool, in which the slug is initially received after perforation, in simple fashion, the slug is held at the end of the plunger during its stay in the slug channel by an adhesion means connected with the plunger. Then, after the hydroforming tool is opened and the finished hollow profile is removed, the slug, while continuing to adhere to the end of the plunger, is guided by means of the plunger and of the removal tool designed with adhesion means into the open die cavity. The slug and the area of the removal tool on which the adhesion means acts assume a relative position opposite one another, after which the slug is separated from the plunger and then adheres to the removal tool, by means of which the adhering slug is then removed from the hydroforming tool.

15 Claims, 3 Drawing Sheets

METHOD AND DEVICE FOR REMOVING A SLUG FROM A HYDROFORMING TOOL

BACKGROUND AND SUMMARY OF THE INVENTION

This application claims the priority of German patent 198 09 519.8, filed Mar. 5, 1998, the disclosure of which is expressly incorporated by reference herein.

The invention relates to a method and a device for removing a slug from a hydroforming tool.

A method and a device for removing a slug from a hydroforming tool are known from U.S. Pat. No. 5,398,533. The device in that patent incorporates a hydroforming tool that is divided along the length of the hollow profile inserted into the die. A recess is provided in the flat bottom surface of the die, which is trapezoidal in cross section. A die button is inserted into the recess for punching the hollow profile under internal high pressure. The die button is flush with the flat surface of the die and has an axial bore in which a plunger is guided. The bore has an annular cutting edge at its opening into the die. The plunger seals off the opening of the bore during the shaping of the hollow profile. Once the shaping process is complete, the plunger is retracted relatively abruptly. Then, under the influence of the internal high pressure that still prevails and because of the lack of support of the hollow profile by the plunger, the hollow profile is pressed against the cutting edge of the bore. Then a slug is separated from the hollow profile and pressed into the slug channel formed by the bore. The fluid pressure is then released and the plunger is lowered again until the slug resting on the end face of the plunger is level with a transverse channel leading to the slug channel that extends into the vicinity of the hydroforming tool. Then the removal tool, designed as a pusher, kicks the slug out of the slug channel through the transverse channel. The plunger is also mechanically driven with a reciprocating movement by the motion of a ramp transversely to the plunger. The plunger is slightly movably mounted on this ramp. The disadvantage of the design of the slug removal that is described, i.e. the removal of the slug from the hydroforming tool, is that it can be used only for punching nearly vertically downward. Otherwise, the slug cannot follow the backward movement of the plunger in the slug channel of the die button and thus cannot be kicked out of the hydroforming tool by the pusher. This is especially true when a plurality of holes are to be made in the same hollow profile in different circumferential areas. If the pressure is not released until the level of the transverse channel is reached, the slug, which until then is pressed against the end of the plunger by internal high pressure, falls off the plunger back down onto the underside of the cutting edge of the die button.

The goal of the invention is to provide an improved method and device that allows removal of the slug from the hydroforming tool in simple fashion from any position of the slug channel that leads into the die of the hydroforming tool in which the slug is initially received after punching.

This goal is achieved according to the invention by providing a method for removing a slug separated from a hollow profile in an internal high pressure hydroforming tool, said hydroforming tool defining a die cavity and a slug channel communicating with said die cavity, and a plunger movably disposed in said slug channel to be retractable into said slug channel and to be extendable into said die cavity, wherein said slug is separated from the hollow profile by retracting the plunger into the slug channel such that the slug abuts an end of the plunger, said method comprising the acts of: adhering said slug to said end of the plunger; opening said hydroforming tool and removing said hollow profile; extending said end of the plunger with the slug adhered thereto into said die cavity and inserting a removal tool into said die cavity; attracting said slug from said plunger to said removal tool; and removing said removal tool with said slug adhered thereto from said die cavity.

This goal is achieved according to the invention by providing a device for removing a slug separated from a hollow profile by internal high pressure hydroforming, comprising: a hydroforming tool defining a die cavity and a slug channel communicating with said die cavity; a plunger movably disposed in said slug channel to be retractable into said slug channel and to be extendable into said die cavity, said slug being separated from the hollow profile by retracting the plunger into the slug channel such that the slug abuts an end of the plunger, means for adhering said slug to said end of the plunger; a removal tool insertable into said die cavity; and means for attracting said slug from said plunger to said removal tool.

Because of the adhesion means on the plunger, the slug can be held on the plunger at all times without being lost, i.e., both under the influence of internal high pressure and also when the pressure fluid is not under pressure, with the path and the position of the slug channel relative to the die of the hydroforming tool having no significance whatsoever as far as the retention of the slug on the plunger is concerned. When the slug is removed, it is advisable to remove it from the side of the die cavity, open after shaping, of the hydroforming tool with the perforated hollow profile removed. When there are several perforations and thus a plurality of slugs being formed, only a single removal tool is required to receive all the slugs, in contrast to the known method, where several pusher-type removal tools are required. This considerably simplifies the hydroforming tool since no recesses need be provided for the pushers and their drives that would reduce the strength of the hydroforming tool. Because of the adhesive property of the removal tool of the invention, the slug, pushed by the plunger into the die cavity and continuing to adhere to the end of the plunger without falling off, during axial insertion of the removal tool into the die cavity, regardless of which circumferential position the slug is in, comes loose from the plunger and is transferred to the removal tool without being lost, and the tool is then brought out of the hydroforming tool together with the slug. The area of the removal tool with adhesive action can be located on all sides in the circumferential direction, so that the slug can be transferred from the plunger to the removal tool in a simple axial movement. For adaptation to the axial position of the plunger and hence of the slug, a plurality of axially spaced areas can be provided which likewise have adhesive action all the way around in the circumferential direction. The area with the adhesive action can also be concentrated locally on the other side, so that, possibly following axial insertion, the removal tool must be rotated around its own axis in order to be opposite the slug with its adhesion area. In general, the invention makes it simple to automate slug disposal.

Other objects, advantages and novel features of the present invention will become apparent from the following detailed description of the invention when considered in conjunction with the accompanying drawings.

DETAILED DESCRIPTION OF THE DRAWINGS

Figure 1:
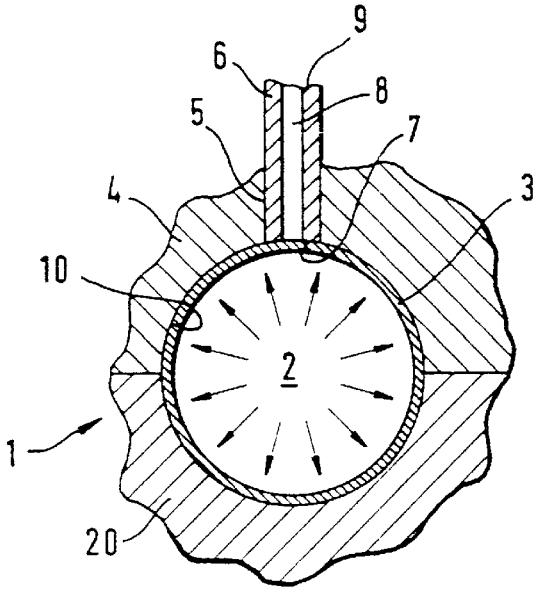
FIG. 1 shows a cross section of a hole punch of the device according to the invention in a hydroforming tool during the shaping of a hollow profile by means of internal high pressure.
Figure 2:
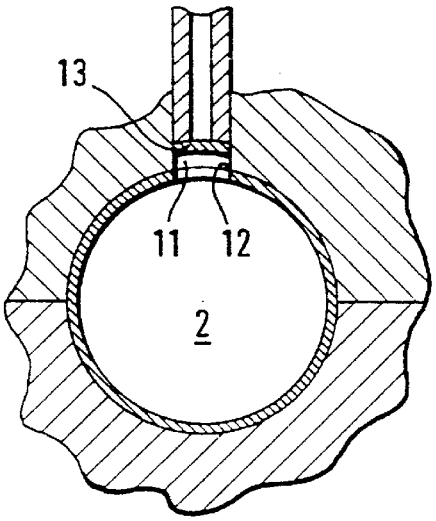
FIG. 2 shows a cross section of the hydroforming tool in FIG. 1 with the plunger retracted to punch an opening in the shaped hollow profile.

FIG. 1 shows a hydroforming tool 1 with a die surface defining a die cavity 2, containing a hollow profile 3. Hydroforming tool 1 is divided in half along the length of hollow section 3 into an upper tool 4 and a lower tool 20. The upper tool 4 defines a slug channel 5, in which a plunger 6 is displaceably guided. The plunger 6 has a diameter that corresponds to that of channel 5, Plunger 6 in FIG. 1 has its end 7 flush with the contour of die cavity 2. An axial through-channel 8 runs in plunger 6, said channel being connected on the side 9 facing away from the die cavity with the suction side of a pump and terminating in the end 7 of plunger 6 in die cavity 9. In the first method step (FIG. 1) to produce a perforated hollow profile, the profile is expanded by applying an internal high pressure in all directions as indicated by the arrow until it abuts die surface 10. While the internal pressure is maintained, plunger 6 is retracted as shown in FIG. 2 into slug channel 5, clearing the channel. Then, due to the lack of support of plunger 6 on the one hand and the hydraulic internal high pressure on the other, hollow profile 3 in the vicinity of opening 11 of slug channel 5 is pressed out of die cavity 2 into channel 5, whereupon as a result of the pulling of the hollow profile material over the opening edge 12 of opening 11, a slug 13 is cut out of hollow profile 3 from the inside to the outside, and the slug then continues to be pressed into slug channel 5 until it comes in contact with the end 7 of the plunger. Slug 13 is thus separated from the area of die cavity 2.

It is advantageous to make the opening edge 12 as a cutting edge so that slug 13 is cleanly separated from hollow section 3. It is also possible to emboss in advance a designated breaking point on hollow profile 3 by an inward movement of plunger 6 into die cavity 2 with internal high pressure acting in the opposite direction, which also has the advantage that slug 13 can be removed with an essentially smooth edge. The pump is then operated, so that suction is exerted on slug 13 through channel 8, causing the slug to adhere to the end of plunger 7. The suction and/or the vacuum that results when slug 13 abuts the end 7 of plunger 6 forms the adhesion means of plunger 6. It is advisable to build up the suction or vacuum even before the perforation process so that slug 13 already abuts the end 7 of the plunger at an early point in the process and thus any pressure drop or escape of high pressure fluid through channel 8 of plunger 6 is avoided. At the same time, the vacuum supports the separation of slug 13 on the side of hollow profile 3 that faces away from the die cavity.

Figure 3:
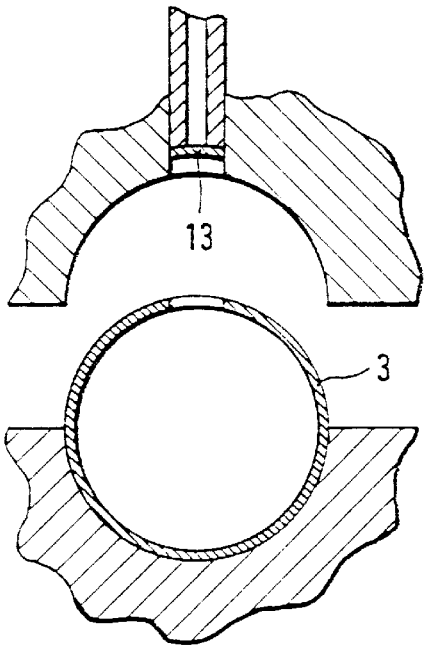
FIG. 3 shows a cross section of the hydroforming tool in FIG. 1 in the open position with a slug adhering to the plunger according to the invention.
Figure 4:
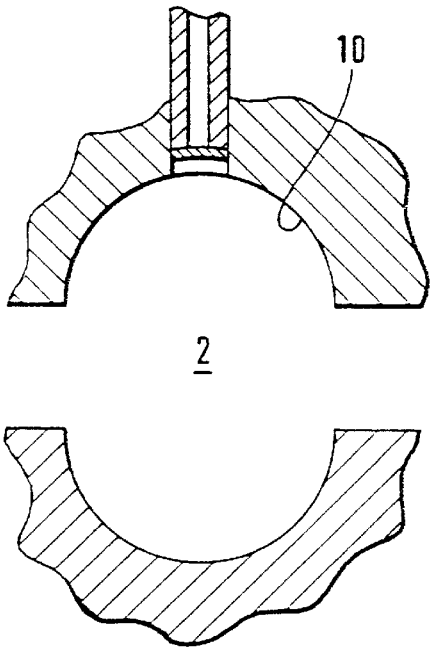
FIG. 4 shows a cross section of the hydroforming tool according to FIG. 1 in the open position and the position of the plunger in FIG. 3 following removal of the hollow profile.

Finally, according to FIG. 3, hydroforming tool 1 can be opened after the pressure of the pressure fluid drops, whereupon slug 13 cannot fall down into the open die cavity 2 because it adheres to plunger 6 under suction. Then the perforated hollow profile 3 is removed from open die cavity 2 (FIG. 4).

Figure 5A:
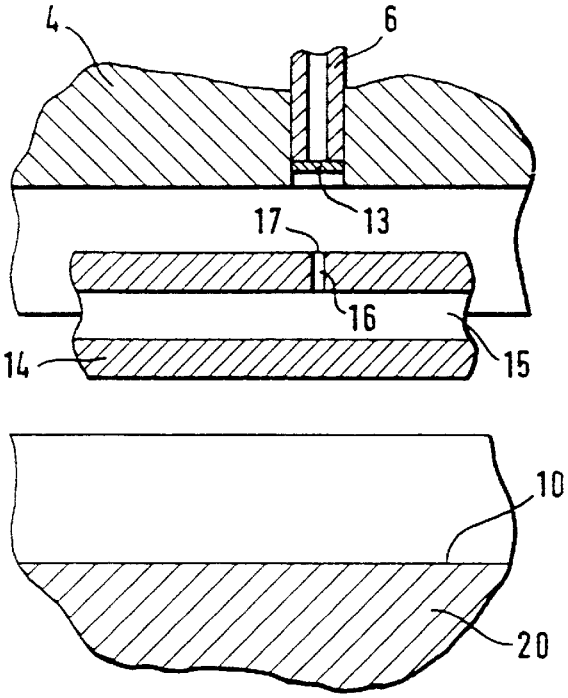
FIG. 5*a* shows a lateral lengthwise section of the hydroforming tool in FIG. 1 with the removal tool of the device according to the invention inserted into the open die cavity.
Figure 5B:
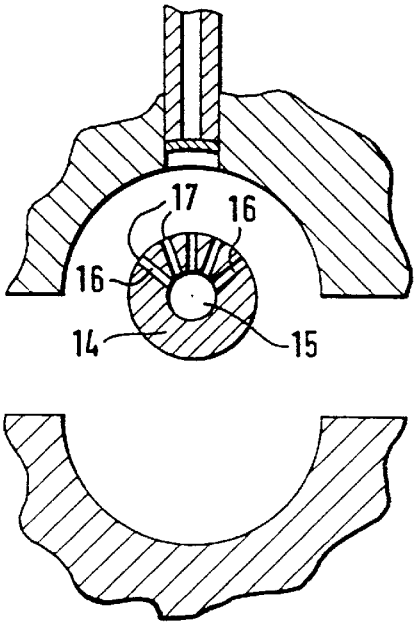
FIG. 5*b* shows a cross section through FIG. 5*a*.

According to FIG. 5*a*, a removal tool 14 designed as a rod for slug 13 is introduced into the open die cavity by means of a robot or even manually. However, the removal tool 14 can also be introduced first into the open die cavity 2 and only then is plunger 6 with slug 13 introduced into the open die cavity 2. Removal tool 14 has a central axial channel 15 from which radial transverse channels 16 (FIG. 5*b*) depart. Axial channel 15 is connected with the suction side of a pump which, during operation, develops a suction in a manner similar to that of plunger 6. Removal tool 14 is positioned axially in die cavity 2 in such fashion that the area with openings 17 of transverse channels 16 is approximately opposite opening 11 of slug channel 5.

Instead of a plurality of radial transverse channels 16, only one such channel can be provided, whereupon removal tool 14, possibly in addition to axial positioning, must also be rotated around the axis of its body until opening 17 of transverse channel 16 is opposite opening 11 of slug channel 5. A plurality of thin channels 16 have the advantage that the suction from the pump extends through axial channel 15 over a relatively large circumferential area of removal tool 14 and thus creates an adhesive area that extends around the circumference. In addition, the same channels 16 ensure good adhesion for slug 13, since the suction is high with this design so that a good suction effect is achieved. As an alternative, the design of a single channel 16 for this purpose, provided with a large cross-sectional area, is simple, but this design has a smaller suction effect and only a limited effective adhesion surface, since in the latter case the slug 13 falls into transverse channel 16.

As the pump operates, the vacuum that builds up in removal tool 14 forms the adhesion means of removal tool 14. After the pump associated with the removal tool is switched on, a suction effect is exerted through the transverse channels 16 on the slug 13 that is in slug channel 5. It is possible that the suction force from removal tool 14 is so much greater than the suction force of the pump connected with plunger 6, so that slug 13 is separated from plunger 6 and is sucked out of channel 5 onto tool 14 where it covers a plurality of openings 17 of transverse channels 16, which openings 17 span the area that forms the adhesion point of slug 13. The adhesion effect of removal tool 14 on slug 13 is generated by a vacuum that acts at the adhesion point.

Figure 6A:
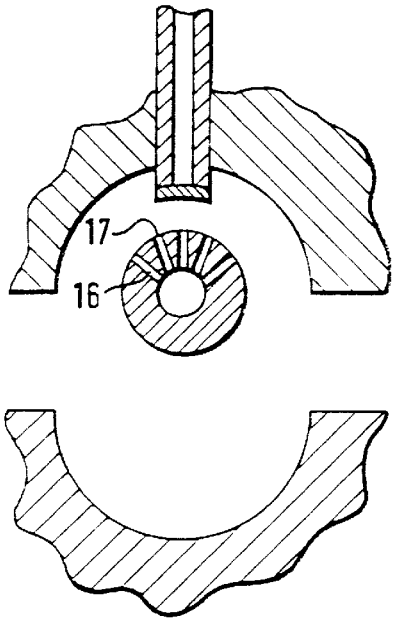
FIG. 6*a* shows a cross section of the hydroforming tool in FIG. 5*a,b* with the plunger projecting into the die cavity.
Figure 6B:
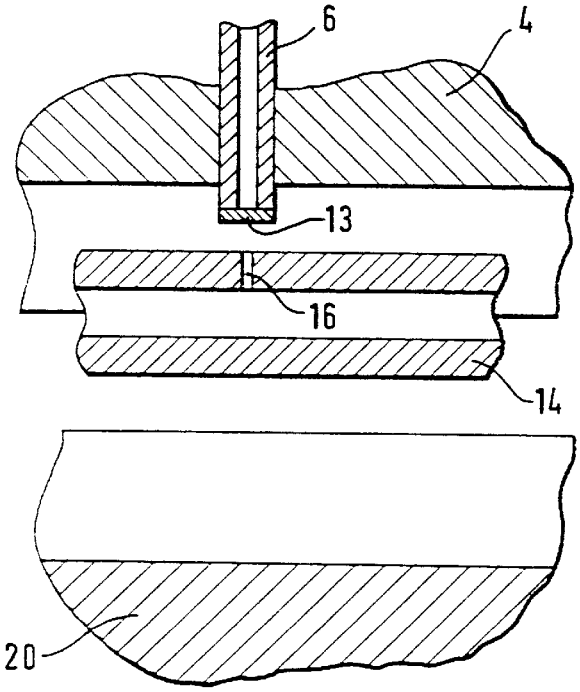
FIG. 6*b* is a lateral lengthwise section of FIG. 6*a*.

This release procedure can be accelerated by switching off the plunger pump, so that the power of the pump of removal tool 14 need not be especially high. Nevertheless there is the possibility that slug 13 will jam in a slot channel 5 when it comes loose from plunger 6. To remedy this uncertainty in the process, before the pump of removal tool 14 shows its effect, plunger 6 together with the slug 13 still adhering to it, may be moved inward from slug channel 5 into die cavity 2 so that jamming when the slug 13 comes loose from the end 7 of the plunger is no longer possible and there is only a short distance from removal tool 14 (FIG. 6*a,b*). By reducing the distance in this way, the suction force, of the removal tool pump that must be applied for separation can be reduced without losing the releasing and adhering effects.

Figure 7A:
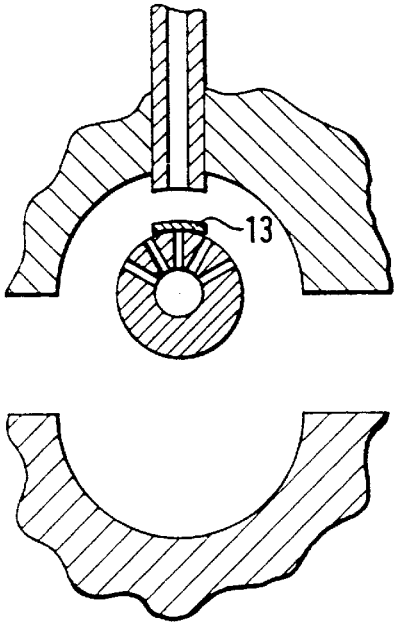
FIG. 7*a* shows in cross section the hydroforming tool in FIG. 6*a,b* with a slug separated from the plunger and adhering to the removal tool.
Figure 7B:
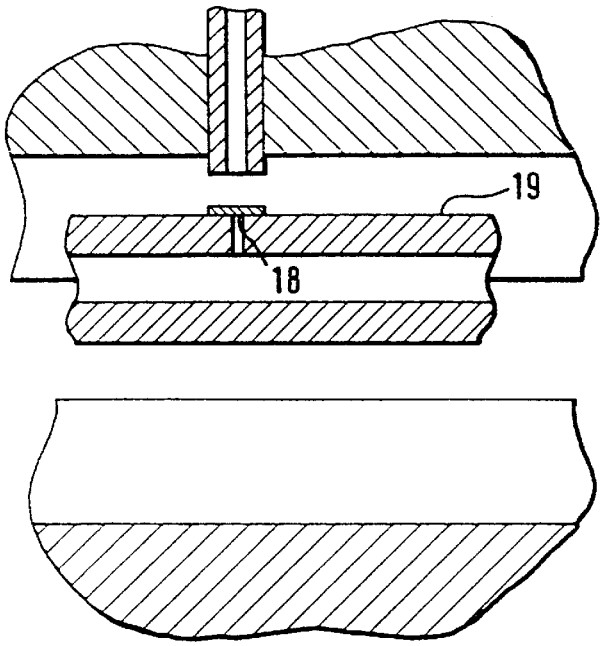
FIG. 7*b* is a lateral lengthwise section of FIG. 7*a*.

The pump then exercises its suction. At the same time the pump connected with plunger 6 can be shut off so that the adhesive force at the plunger is released and only the suction force on slug 13 exerted by removal tool 14 is operative and closes off most of openings 17 and adheres to the outside 19 of removal tool 14 as a result of the vacuum that builds up on its underside 18. At the same time of course it is also possible for both pumps to remain operating, with the pump of removal tool 14 having a higher suction force than that of plunger 6 so that as a result the adhesion of slug 13 to plunger 6 is released and the slug comes free. Accordingly, the slug is attracted by removal tool 14 and remains adhering to tool 14 (FIG. 7*a,b*).

Figure 8A:
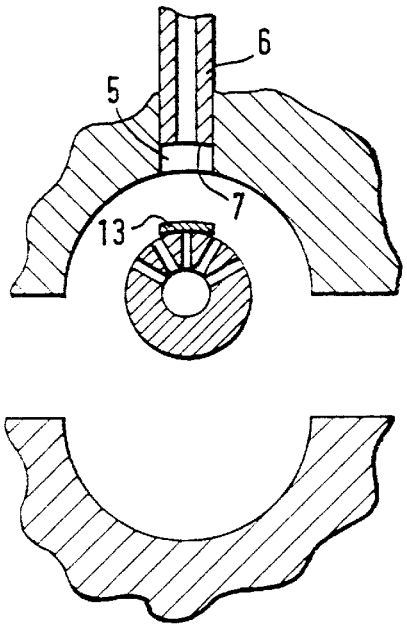
FIG. 8*a* is a cross section of the hydroforming tool in FIG. 7 *a,b* with the plunger retracted into the slug channel of the hydroforming tool.
Figure 8B:
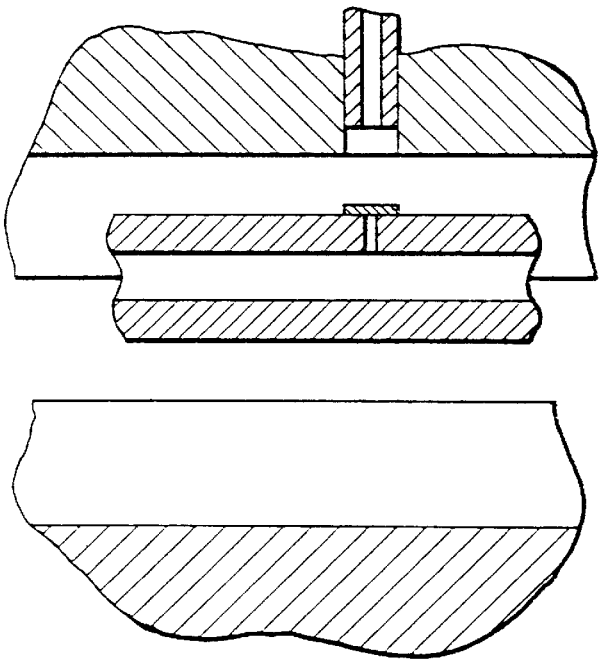
FIG. 8*b* is a lateral lengthwise section of FIG. 8*a*.

In order to remove removal tool 14 without impediment from die cavity 2 with slug 13 adhering to it and thus remove the slug from hydroforming tool 1, according to FIG. 8*a,b* plunger 6 is then brought out from mold cavity 2 into a position in which it is retracted in slug channel 5.

As an alternative to the adhesion means for plunger 6 and removal tool 14 based on suction or vacuum, it is contemplated to design plunger 6 and removal tool 14 in rod form as electromagnets. In this connection it is of course absolutely necessary that the hollow section 3 and hence the slug 13 consist of a magnetic or magnetizable material. It is advantageous for the reliability of the process that the hydroforming tool 1 then consist of a non-magnetic material. Instead of the non-magnetic design of hydroforming tool 1, a shielding insert can also be provided in slug channel 5 which shields the field of plunger 6 from the surrounding magnetic hydroforming tool 1.

The stage of the process with the electromagnetics serving as adhesion means largely corresponds to the first embodiment described above and shown in the figures, with the field of an electromagnet being just as easy to switch off or on as a pump for producing a vacuum. Slug 13 is attracted by electromagnetic plunger 6 and remains adhering thereto until it is removed by the stronger magnetic field of electromagnetic removal tool 14. When using electromagnets it is advantageous for removal tool 14 not to have to assume a specific axial position relative to plunger 6 or slug 13, since the attractive force acts over its entire axial length and is not limited to openings 17.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for removing a slug separated from a hollow profile in an internal high pressure hydroforming tool, said hydroforming tool defining a die cavity and a slug channel communicating with said die cavity, and a plunger movably disposed in said slug channel to be retractable into said slug channel and to be extendable into said die cavity, wherein said slug is separated from the hollow profile by retracting the plunger into the slug channel such that the slug abuts an end of the plunger, said method comprising the acts of:

adhering said slug to said end of the plunger;

opening said hydroforming tool and removing said hollow profile;

extending said end of the plunger with the slug adhered thereto into said die cavity and inserting a removal tool into said die cavity;

attracting said slug from said plunger to said removal tool; and removing said removal tool with said slug adhered thereto from said die cavity.

2. A method according to claim 1, wherein said adhering act is effected via a plunger adhesion means which produces an adhesive force on said slug, said attracting act being effected via a removal tool adhesion means which produces an attractive force on said slug, said attractive force being greater than said adhesive force.

3. A method according to claim 2, wherein said adhesive force of said plunger adhesion means is reduced during said attracting act.

4. A method according to claim 1, wherein said adhering act is effected via a vacuum developed at said end of the plunger.

5. A method accorded a claim 1, wherein said adhering act is effected by forming said slug of a magnetic material, and providing an electromagnet acting through said plunger.

6. A method according to claim 1, wherein said attracting act is effected electromagnetically.

7. A method according to claim 1, wherein said attracting act is effected via a vacuum developed at the removal tool.

8. A device for removing a slug separated from a hollow profile by internal high pressure hydroforming, comprising:

a hydroforming tool defining a die cavity and a slug channel communicating with said die cavity;

a plunger movably disposed in said slug channel to be retractable into said slug channel and to be extendable into said die cavity, said slug being separated from the hollow profile by retracting the plunger into the slug channel such that the slug abuts an end of the plunger, means for adhering said slug to said end of the plunger;

a removal tool insertable into said die cavity; and means for attracting said slug from said plunger to said removal tool.

9. A device according to claim 8, wherein said removal tool comprises a rod defining a central axial channel and at least one radial transverse channel, said at least one radial transverse channel to be faced to said end of the plunger, said axial channel being communicated with a vacuum source such that a vacuum attraction force at said radial transverse channel is said means for attracting.

10. A device according to claim 8, wherein said slug is formed of a magnetic material, and wherein said removal tool is an electromagnet, an electromagnetic attractive force of said removal tool being said means for attracting.

11. A device according to claim 10, wherein said hydroforming tool is made of a non-magnetic material.

12. A device according to claim 8, wherein said plunger defines an axial through-channel extending to said end of the plunger, said channel being communicated with a vacuum source, a vacuum attraction force at said end being said means for adhering.

13. A device according to claim 8, wherein said slug is formed of a magnetic material, and wherein said plunger is an electromagnet, an electromagnetic attractive force of said plunger being said means for adhering.

14. A device according to claim 13, wherein said hydroforming tool is made of a non-magnetic material.

15. A device according to claim 8, wherein said slug is formed of a magnetic material, and wherein said plunger is an electromagnet having an electromagnetic field which is shielded from a surrounding portion of said hydroforming tool.

* * * * *